United States Patent [19]

Derderian et al.

[11] Patent Number: 4,535,553

[45] Date of Patent: Aug. 20, 1985

[54] SHOCK ABSORBING SOLE LAYER

[75] Inventors: Thomas Derderian, Exeter; Edward C. Frederick, Kingston, both of N.H.; Alexander L. Gross, Aspen, Colo.

[73] Assignee: Nike, Inc., Beaverton, Oreg.

[21] Appl. No.: 531,087

[22] Filed: Sep. 12, 1983

[51] Int. Cl.[3] ..... A43B 13/18

[52] U.S. Cl. ..... 36/28; 36/29

[58] Field of Search ..... 36/28, 25 R, 32 R, 29, 36/30 A, 30 R

[56] References Cited

U.S. PATENT DOCUMENTS

| | | | |
|---|---|---|---|
| 413,693 | 10/1889 | Walker . | |
| 1,088,328 | 2/1914 | Oucinotta . | |
| 1,098,241 | 5/1914 | Forray . | |
| 1,221,632 | 4/1917 | Tysse . | |
| 1,380,879 | 6/1921 | Young . | |
| 1,502,087 | 7/1924 | Bunns . | |
| 2,299,009 | 10/1942 | Denk . | |
| 2,437,227 | 3/1948 | Hall | 36/30 |
| 2,668,374 | 2/1954 | Seigle . | |
| 2,669,038 | 2/1954 | De Werth . | |
| 2,710,460 | 6/1955 | Stasinos | 36/28 |
| 2,721,400 | 10/1955 | Israel . | |
| 2,968,105 | 1/1961 | Rizzo | 36/29 |
| 3,777,374 | 12/1973 | Hendricks . | |
| 3,790,150 | 2/1974 | Lippert . | |
| 4,033,567 | 7/1977 | Lipfert . | |
| 4,187,620 | 2/1980 | Seiner . | |
| 4,262,433 | 4/1981 | Hagg et al. | 36/25 R |
| 4,267,648 | 5/1981 | Weisz | 36/28 |
| 4,271,606 | 6/1981 | Rudy . | |
| 4,283,864 | 8/1981 | Lipfert | 36/28 |
| 4,297,796 | 11/1981 | Stirtz et al. . | |
| 4,322,893 | 4/1982 | Halvorsen . | |
| 4,451,994 | 6/1984 | Fowler | 36/28 |

*Primary Examiner*—Werner H. Schroeder
*Assistant Examiner*—Mary A. Ellis
*Attorney, Agent, or Firm*—Banner, Birch, McKie & Beckett

[57] ABSTRACT

A shock absorbing sole member used in an athletic shoe having an upper and a sole is disclosed. The shock absorbing sole member is comprised of an insert member and elastomeric foam encasing the insert member. The insert member is formed of resilient plastic material and includes a plurality of transversely and longitudinally spaced discrete shock absorbing projections. The elastomeric foam has a low hardness, less than 70 on the Asker C scale.

41 Claims, 11 Drawing Figures

SHOCK ABSORBING SOLE LAYER

TECHNICAL FIELD

The present invention relates to shoes, and in particular, to a shock absorbing sole layer used with athletic shoes.

BACKGROUND OF THE INVENTION

The modern athletic shoe is highly refined combination of many elements which have specific functions, all of which must work together for the support and protection of the foot during an athletic event. A shoe is divided into two general parts, an upper and a sole.

The upper is designed to snugly and comfortably enclose the foot. Typically, it will have several layers including a weather- and wear-resistant outer layer of leather or synthetic material such as nylon, and a soft, padded inner liner for foot comfort. Current uppers typically have an intermediate layer of a synthetic foam material. The three layers of the upper may be fastened together by stitching, gluing, or a combination of these. In areas of maximum wear or stress, reinforcements of leather and/or plastic are attached to the upper. Examples of such reinforcements are leather toe sections attached over synthetic inner layers of the toe area and heel counters made of an inner layer of plastic and an outer layer of leather.

The other major portion of an athletic shoe is the sole. Designed to withstand many miles of running, it must have an extremely durable bottom surface to contact the ground. However, since such contact may be made with considerable force, protection of the foot and leg demands that the sole also perform a shock-absorbing function. It therefore typically includes a resilient, energy-absorbent material as a midsole in addition to the durable lower surface. This is particularly true for training or jogging shoes designed to be used over long distances and over a long period of time.

The normal motion of the foot of a typical runner during running proceeds as follows. The foot hits the ground heel first, then rolls forwardly and inwardly, (abducts, everts and dorsilflexes) over the ball of the foot and the toes. As the foot rolls forward, the toes make contact with the ground; the heel leaves the ground; the toes push off from the ground; and finally the entire foot leaves the ground to begin another cycle. During the time that the foot is moving from heel strike toward ball contact, it typically is rolling from the outside or lateral side, to the inside or medial side, a process called pronation. During motion through ball and toe contact the foot rotates outward (adducts, inverts and plantarflexes) and becomes rigid as the toes prepare to push off, a process called supination. While the foot is airborne and preparing for another cycle, the foot remains supinated.

Pronation, the inward roll of the foot in contact with the ground, although normal, can be a potential source of foot and leg injury, particularly if it is excessive. Various devices incorporated either onto the upper or into the sole have been devised to limit pronation to a reasonable range. In the design of an overall sole, lateral motion control; i.e., the control of pronation and supination, must be taken into consideration. Particular care must be taken in the design of a cushioning midsole because of its inherent tendency to compress, and thus add additional lateral motion to the foot. Thus, while a cushioning midsole must be compressible to perform its shock-absorbing function, adequate lateral control for the overal shoe must still be present. While a midsole contributes to a loss of lateral control, other devices, such as heel counters or reinforcements, can be added to increase lateral control. However, control which can be added by means of such devices is limited. Therefore, a midsole cannot be designed with such compressibility that would make adequate lateral control unattainable.

Another limiting factor in the design of a cushioned midsole is the range of suitable cushioning materials. Current commercial cushioned midsoles use elastomeric foam, such as ethlene vinyl acetate EVA foam, within a narrow mid-range of hardness, or an elastomeric foam within which a gas-filled membrane is encapsulated. The use of elastomeric foam material by itself is limited to foams of relatively higher density and hardness, because low density and hardness foams are too soft and bottom out too quickly, i.e., collapse to a point where it no longer functions as shock absorber under relatively low force, and also because low hardness foams provide very little lateral stability. Hence, prior art commercial midsoles have generally been limited to higher density, relatively hard foams; i.e., foams with densities of 0.4 and above and hardness within the range of Shore A 25 and harder. The commercial use of foams within this narrow range of hardness reaches a compromise between cushioning and stability. The use of a softer foam would provide additional cushioning at a sacrifice to lateral stability. Conversely, the use of harder foams would enhance lateral stability at a sacrifice to cushioning.

The use of a membrane partitioned into a plurality of chambers which are filled with a gas, which in turn is incorporated into a foam midsole, improved the cushioning capability of the midsole over that of conventional EVA foam because it does not bottom out as rapidly. The present invention, as will be discussed more fully hereinafter, improves the cushioning capabilities of a midsole layer even further.

Other cushioning techniques have been disclosed for both athletic and dress shoes in the patent literature. For example, U.S. Pat. Nos. 2,437,227, 2,721,400 and 4,267,648 disclose the use of coil springs within a cushioning midsole layer. In the '227 and '400 patents, the cushioning midsole layers are used in dress shoes and additionally use other cushioning material such as sponge rubber. In the '648 patent, spring mechanisms, such as disc or Bellville washer-type springs, are disclosed for use in athletic shoes.

U.S. Pat. No. 4,283,864 discloses a cushioning material construction formed of integral plastic modules. The modules are composed of a plurality of levers and spaced bearing means which are incorporated into the midsole area of footwear.

SUMMARY OF THE INVENTION

The present invention is directed to a shock absorbing sole member used in an athletic shoe having an upper and a sole. The shock absorbing sole member is comprised of an insert member and elastomeric foam encasing the insert member. The insert member is formed of resilient plastic material and includes a plurality of transversely and longitudinally spaced discrete shock absorbing projections. The elastomeric foam has a low hardness, less than 65 on the Asker C scale.

The present invention is also directed to the insert member, per se, which is incorporated into the sole of the footwear, and to athletic shoes using the shock absorbing sole member. The insert member is made up of a plurality of elongated base elements, elongate flexible legs and discrete connecting elements. The base elements are interconnected to delineate the base perimeters of a plurality of interconnected open cells. The elongate flexible legs extend from the base elements of a plurality of the cells. Groups of the flexible legs converge towards one another to define a plurality of generally truncated-conical shaped projections, each of the convergent ends of the flexible elements of one of the projections is connected by one of the discrete connecting elements. A load placed on the cells of the base elements or on the connecting elements causes the flexible legs to resiliently flex and thus absorb the load.

In the preferred form of the invention, the base elements, flexible legs and connecting elements are formed of a single integral piece of plastic material and the resilient foam is formed of a density less than 0.40 and a hardness of less than 70 durometer on the Asker C scale and preferable between 20 and 50 on the Asker C scale. The base elements are preferably substantially linear whereby the cells defined by the base elements are polygons. One of the flexible elements preferably extends from each corner of the polygons.

It is frequently desirable to vary the cushioning characteristics of the midsole, dependent upon the particular location along the midsole, for example, to make the midsole stiffer along the medial heel section of the sole. To accomplish this, the insert member can include projections which have flexible legs of varying thickness.

The combination of the insert member and the encasing low density foam material attains shock absorbing to a degree heretofor unattainable. FIGS. 10 and 11 are graphs illustrating the shock absorbing characteristics of various materials and combinations of materials.

FIG. 10 compares the shock absorbing characteristics of various midsole materials. In FIG. 10, line A indicates the shock absorbing characteristics of EVA foam having a density of approximately 0.4 and a hardness of approximately 35 durometer on the Shore A scale, which is typically used as a midsole material in running shoes; line B indicates the shock absorbing characteristics of a midsole comprised of a gas-filled membrane encased in a foam material, such as disclosed in U.S. Pat. No. 4,271,606; and lines $C_1$ and $C_2$ indicate the shock absorbing characteristics of two embodiments of shock absorbing sole members of the present invention.

FIG. 11 compares the shock absorbing characteristics of a shock absorbing sole member of the present invention with that of its various components. In FIG. 11, line $C_3$ indicates the shock absorbing characteristics of another embodiment of sole member according to the present invention; line D indicates the shock absorbing characteristics of a low hardness foam used to encase the plastic insert member of the sole member; and lines $E_1$ and $E_2$ indicate the shock absorbing characteristics of plastic insert members, $E_1$ being a relatively soft insert member and $E_2$ being a harder insert member. The relative hardness-softness of the insert members can be adjusted by either changing the material of which it is made, or the thickness of the legs of the insert members. For example, the flex modules of the material can range between approximately 2,000 PSI and 9,000 PSI (ASTM D790), or the thickness of the legs can range between approximately 0.02 inches and 0.10 inches.

The shock absorbing characteristics illustrated in FIGS. 10 and 11 are obtained by an impact testing technique wherein the material being tested is placed on top of a support surface and a standard weight with a preselected contact surface area is dropped on top of the material from a preselected height, for example 5 cm. The weight contains a piezoelectric crystal which produces a signal proportional to the force decelerating the weight over the period of time while the weight contacts and penetrates the material; and this force is converted to an impact pressure in pounds per square inch, which is shown on the vertical axis of FIGS. 10 and 11. The amount the material compresses, actually the amount the weight penetrates the material, over time is also sensed and correlated to the impact pressure. The horizontal axis of FIGS. 10 and 11 plots the compression as a percentage of the original thickness of the material. These graphs thus illustrate the sensed impact as a function of the compression of the material, and serve as a model to estimate the shock absorbing capability of the material being tested. A similar model to estimate the shock absorbing capability of materials could be attained using stress-strain testing techniques. The lower portion of each plotted line represents the compression or impact portion of the time the weight is in contact with the material, and the upper portion represents the expansion or rebound portion. The steeper the slope on the curve, the harder the material becomes when it is compressed, and thus functions less effectively as a shock absorber. Bottoming out of the material is indicated when the slope of the curve is essentially vertical.

As seen for the EVA illustrated by line A, the material has reached its limit of compressibility, i.e., has bottomed out, and thus stops acting as a shock absorber, after only a small degree of compression (25%) and the sensed impact rapidly increases after that point. The relative steepness of the curve also indicates the material's relative effectiveness as a shock absorber. Line B illustrates the typical improvement in shock absorbing attained by incorporating a gas-filled membrane into the foam material of a midsole. The membrane is divided into a plurality of channels and filled with a gas of high molecular size, such as disclosed in U.S. Pat. No. 4,271,606. Such a sole does attain an improvement over the typical EVA midsole by reducing the steepness of the curve, and thus reducing the sensed impact. However, as seen by lines $C_1$–$C_3$ in FIGS. 10 and 11, a midsole made in accordance with the present invention further increases the desired cushioning effect of the midsole by further reducing the steepness of the curve.

Furthermore, as seem by lines D, $E_1$ and $E_2$ of the graph in FIG. 11, such advantageous cushion effect cannot be attained by either of the parts of the present invention alone. As illustrated by line D, the low density foam material would compress to a totally collapsed position relatively rapidly at a relatively low force (25 PSI) load, thus being useless at higher force loads, which typically occur during running, i.e., 100 to 125 psi. This high force load would be sharply transmitted to the foot because the material has bottomed out, as indicated by the substantially vertical line. Additionally, such a low density foam would be so soft that it would provide very little lateral stability. As illustrated by lines $E_1$ and $E_2$ the shock absorbing capability of the insert member is dependent upon the material of which the member is made or the thickness of its legs. Line $E_1$ illustrates typical characteristics of a relatively soft insert member made of, for example, a Hytrel 4056 with a flex modulus of about 2,000 PSI and having leg thicknesses of 0.040"; while line $E_2$ illustrates typical characteristics of a harder or stiffer insert member made of, for example, a Hytrel 4056 with a flex modulus of about 7,000 PSI and having leg thicknesses of 0.060". However, the combination of the low density encasing foam and the insert member unexpectedly provides excellent cushioning, as illustrated by lines $C_1$–$C_3$. As seen therein, the slope of the curves in less than that of the EVA or the gas-filled membrane midsole, and no sharp vertical rise, indicating bottoming out, is seen. This excellent cushioning characteristic is attained without any undue sacrifice to lateral stability.

Various advantages and features of novelty which characterize the invention are pointed out with particularity in the claims annexed hereto and forming a part hereof. However, for a better understanding of the invention, its advantages, and objects obtained by its use, reference should be had to the drawings which form a part hereof and to the accompanying descriptive matter in which there is illustrated and described preferred embodiments of the invention.

DETAILED DESCRIPTION OF THE INVENTION

Figure 1:
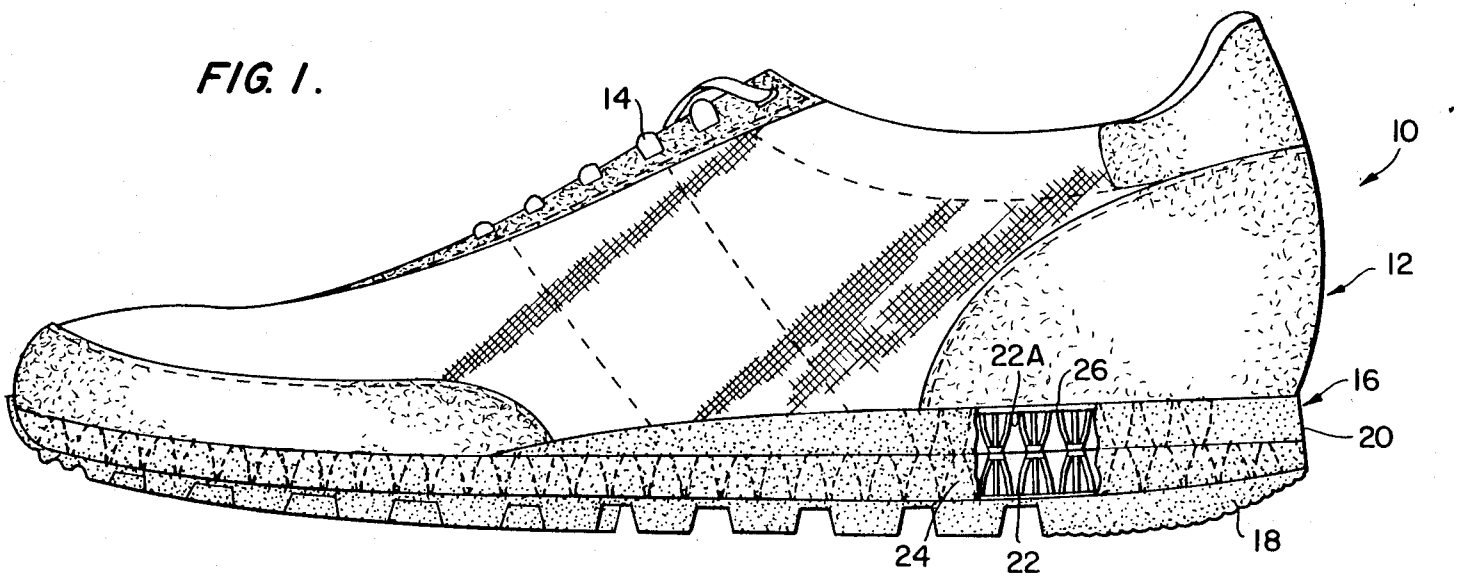
FIG. 1 is a side elevational view of an athletic shoe incorporating a shock absorbing sole layer in accordance with the present invention.
Figure 2:
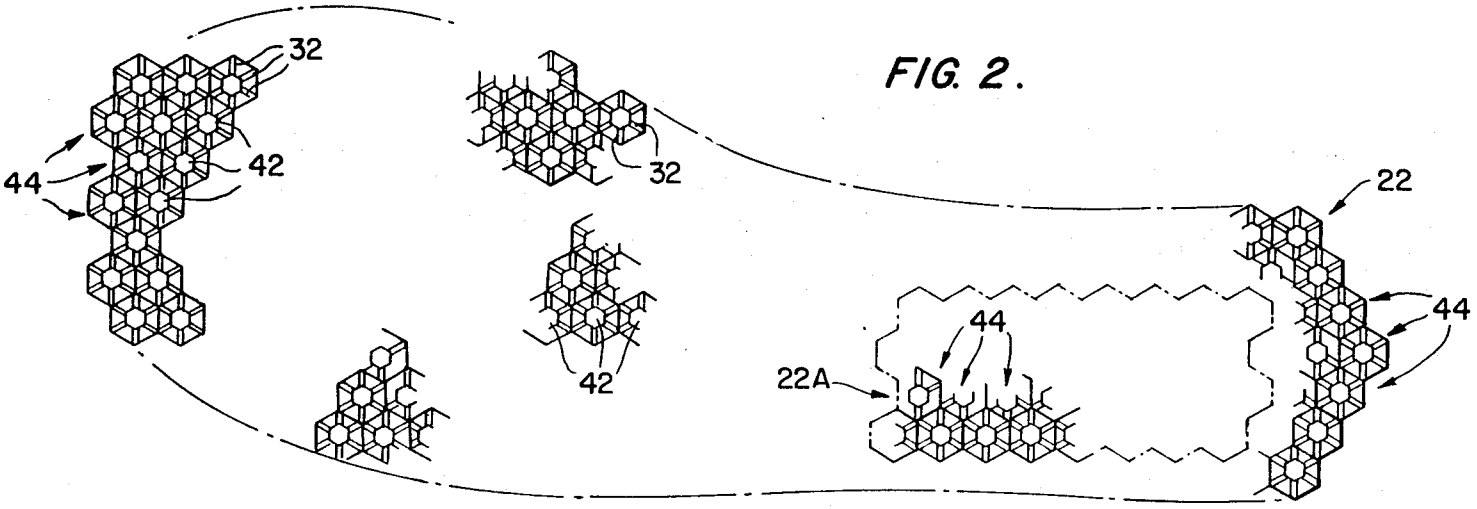
FIG. 2 is a plan view of the insert member in accordance with the present invention illustrating only some of the projections.
Figure 3:
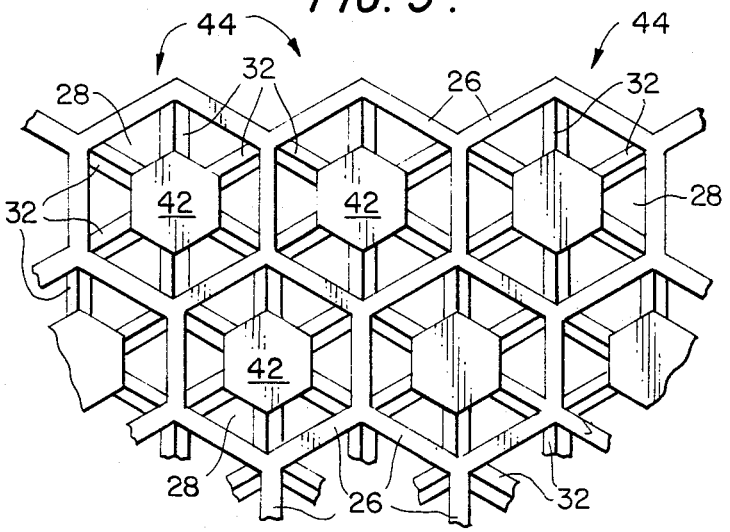
FIG. 3 is an enlarged top plan view of several of the projections of the insert member.
Figure 4:
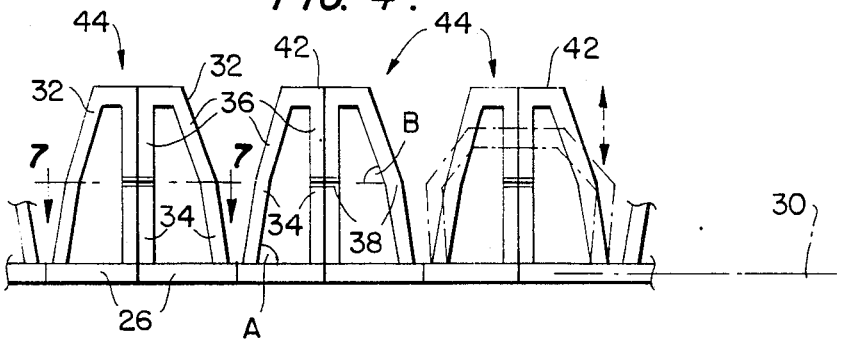
FIG. 4 is an enlarged side elevational view of several projections of the insert member.

Referring to the drawings in detail, wherein like numerals indicate like elements, there is shown in FIG. 1 an athletic shoe in accordance with the present invention designated generally as 10. Shoe 10 includes a shoe upper 12 which extends completely around the foot and includes provisions for lacing 14. A multilayered sole 16 is attached to the upper 12 and includes an outer sole 18 and a midsole 20. Outer sole 18 is preferably made of a conventional hard resilient and flexible wear-resistant material such as rubber or a comparable synthetic material. Outer sole 18 is also preferably contoured on its bottom surface to increase traction.

Midsole 20 forms a shock absorbing sole layer and is comprised of an insert member 22 encased in a resilient foam material 24. Insert member 22 is preferably formed of a single integral molded piece of resilient plastic material. Materials such as Hytrel-polyester, nylon, Krayton, polyurethanes, Surlyn and blends thereof have been found to be suitable materials for insert member 22, particularly Hytrel.

Foam material 24 is preferably a synthetic elastomeric foam material such as polyurethane, and has a relatively low density approximately at or below 0.40 and a harness below 70 durometer and preferably in the range of 20 to =durometer on the Asker C scale. However, current available foams below a density of about 0.15 are too fragile to undergo the stress placed on a midsole of a running shoe.

Insert member 22 is made up of a plurality of elongate base member 26 which are interconnected in a pattern defining a plurality of open cells 28. Base members 26 are preferably linear and are interconnected so that open cells 28 define a plurality of joined polygons having common sides. Also, base members 26, and the cells 28 defined thereby, preferably are located in a first plane 30.

A plurality of elongate flexible legs or elements 32 are connected to base elements 26 and extend transversely of the first plane. Flexible legs 32 are also substantially linear and have a first section 34 which extends from the first plane at a first angle A of close to 90°, such as 85° and a second section 36 extending from the first section at a second angle B, e.g., 60°, with respect to a plane parallel to first plane 30. First and second sections 34, 36 thus define between them a deflection or break point 38 at which flexible legs 32 will naturally first break or bend when pressure is applied to legs 32. Flexible legs 32 are arranged in a plurality of groups wherein the legs 32 in each respective group converge toward one another to define a generally truncated-conical or pyramid-shaped side. The convergent ends of flexible legs 32 within each group are joined by a connecting element or cap 42 so that each group of converging flexible legs 32 together with the interconnecting connecting element 42 and the joining base elements 26 define a generally conical-shaped or pyramid shaped projection 44.

Figure 6:
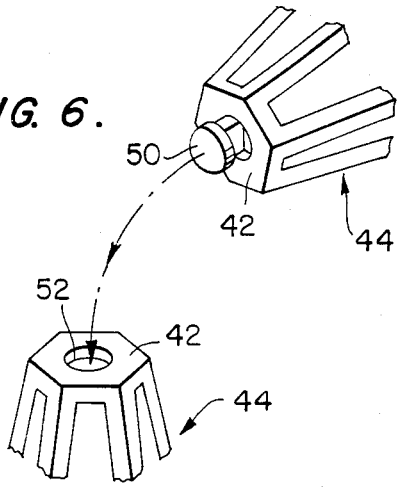
FIG. 6 is a perspective view of the interconnection between an upper and a lower projection.

In certain athletic shoes, particularly training or jogging shoes, it is desired to incorporate a heel lift into the sole in order to slightly elevate the heel above the ball of the foot. To accomplish this, midsole 20 includes a second layer of insert member **22*a* above insert member 22 in the area of the heel and a portion of the arch. Insert member 22*a* is inverted with respect to insert member 22 so that their adjoining connecting elements or caps 42 contact one another. The contacting connecting elements 42 are connected to one another. A preferred technique for connecting the contacting connecting elements 42 is by the friction engagement of a plug 50 extending from one cap 42 with a hole 52 formed in the adjoining cap 42, as shown in FIG. 6**.

Figure 5:
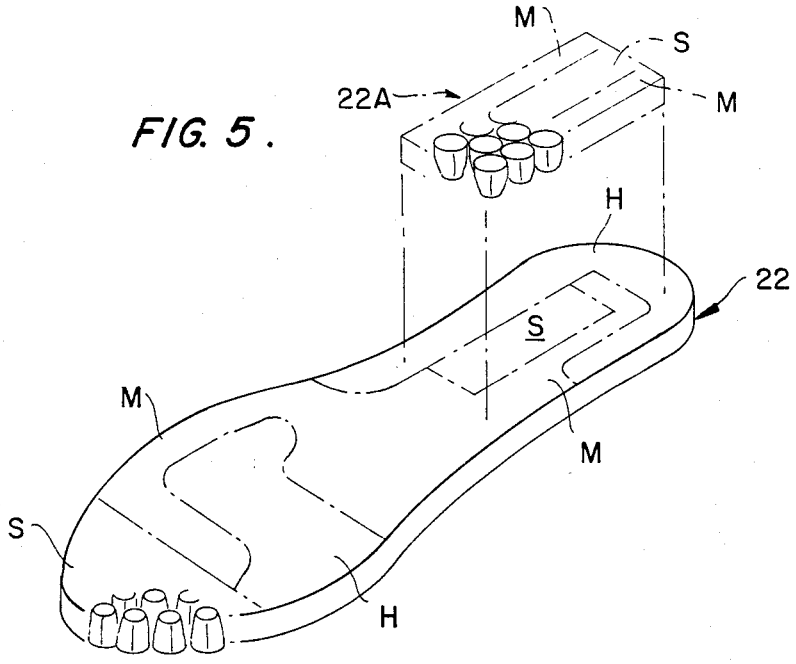
FIG. 5 is a diagrammatic perspective view of the insert member delineating the varying stiffness of the insert member at different areas of the sole layer.

The foot of an athlete undergoes stresses or forces which vary in degree dependent upon the location along the length and width of the foot. In normal running and jogging strides, the foot undergoes maximum stress at the heel and ball areas of the foot, while the arch area is subjected to minimal stress. The present invention allows midsole 20 to be tailored to accommodate such varying stresses or forces, by varying the stiffness of projections 44. FIG. 5 illustrates zones in insert members 22 and 22*a* wherein the stiffness of the projections varies from hard in the areas indicated by H, to medium in areas indicated by M, and to soft in areas indicated by S. For stability and support in the heel and arch area, insert member 22 includes a hard border and insert member 22*a* includes a medium stiffness border; while, to provide shock absorbancy of heel strike, the center of the heel areas has relatively soft projections. Also, for support in the ball area of the foot, an area of relatively hard projections is provided.

Figure 7:
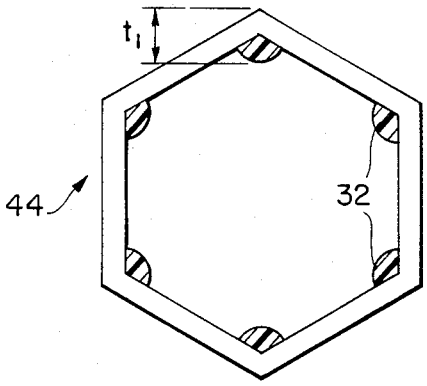
FIG. 7 is a cross-sectional view through a single projection taken generally alone line 7—7 of FIG. 4.
Figure 8:
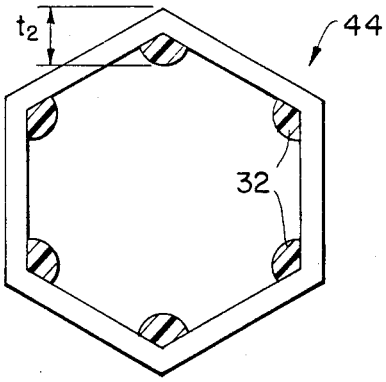
FIG. 8 is a cross-sectional view through a single projection having legs thicker than the legs of the projection shown in FIG. 7.
Figure 9:
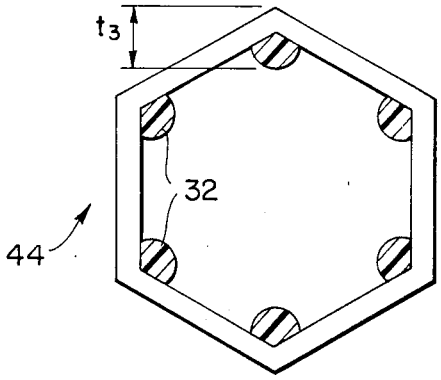
FIG. 9 is a cross-sectional view through a single projection, having legs thicker than the legs of the projections shown in FIGS. 7 and 8.

As mentioned in the summary of the invention, the stiffness or hardness of the projections can be varied by either varying the material of which the projections are made, or varying the thickness of the legs. To construct an integral insert member with varying stiffnesses, a practical technique is to vary the thicknesses of legs 42 in the molding process. FIGS. 7 through 9 illustrate projections 44 wherein legs 32 have thicknesses varying from the smallest $t_1$, to a medium thickness $t_2$ and a largest thickness $t_3$. As seen in these figures, the outwardly facing surface of legs 32 is the same, so that the thickness of legs 32 is varied by increasing the diameter or thickness of legs 32 in the interior area of projections 44. Of course, any other simple technique for varying the thickness of legs 32 to accomplish varying stiffness could be used.

Figure 10:
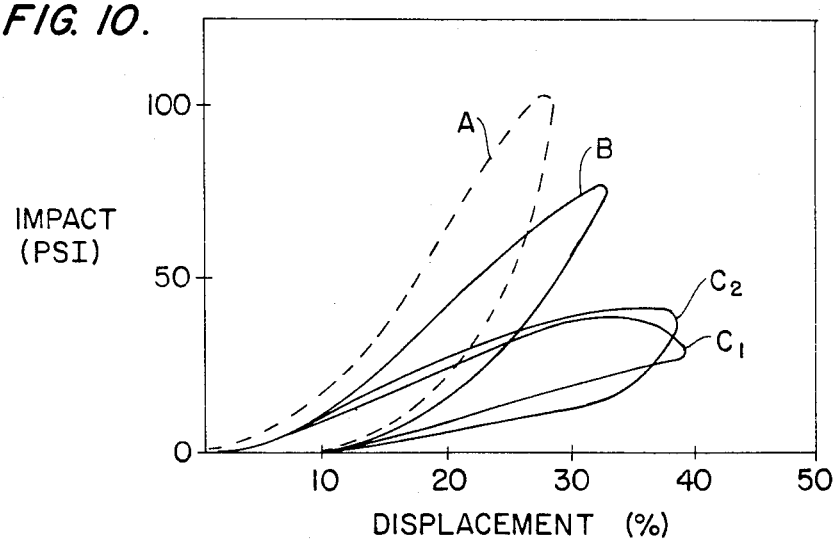
FIG. 10 is a graph illustrating the shock absorbing effect of the present invention as compared to the shock absorbing effect of prior art sole layers.
Figure 11:
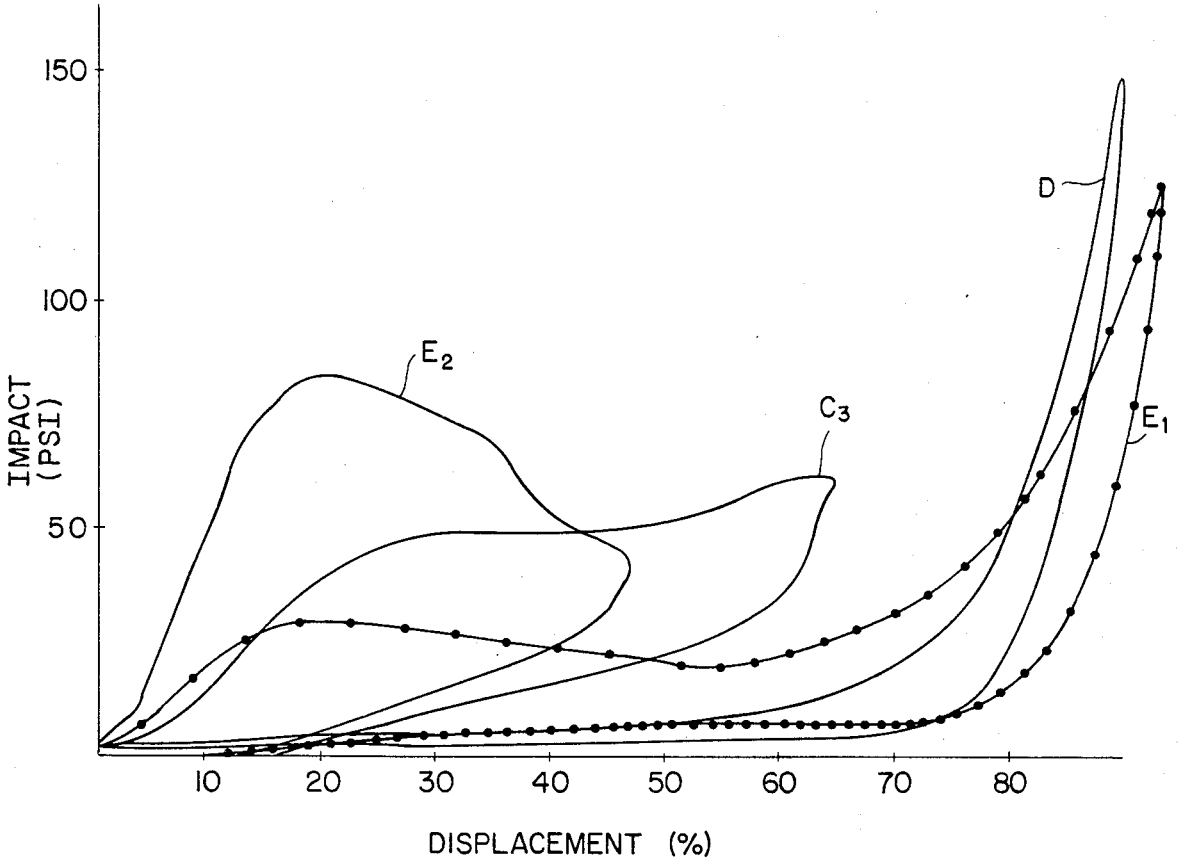
FIG. 11 is a graph illustrating the separate shock absorbing effect of the insert member and the encapsulating low hardness foam, as well as the shock absorbing effect of a combined insert member and low hardness foam.

Insert members 22, 22A and encasing elastomeric foam 24 function as first and second shock absorbing means and work cooperatively together to absorb the force of foot strike. Insert members 22, 22*a* and foam 24 have a predetermined thickness and are compressible to a percentage of this thickness during normal force loads which are generated during the particular athletic activity for which the shoe is designed. The insert members supply the primary resistance to compression during the low level loads and during the initial portion of the compression of midsole 20. At higher force levels, the insert members 22 and foam 24 together supply the primary resistance to compression. More specifically, projections 44 can be looked at as collapsible structures which have an initial relatively high resistance to collapse, however, at a certain point of collapse, where a certain force is exceeded, the projections 44 buckle and the amount of resistance to collapse of the projection decreases significantly. Thus, at the initial lower force levels, the projections 44 provide the primary resistance to compression of midsole 20, because even at the lower level of stress, low hardness foam provides little resistance to compression (line D of FIG. E). However, once the projections have passed the buckling point, foam 24 has compressed sufficiently to provide, in combination with the lesser yet remaining resistance of projections 44, resistance to further compression. The combination of the somewhat compressed low hardness foam and projections 44 after buckle extends the shock absorbing capability of midsole 20 further than heretofore been capable in prior art midsole designs. Of course, a proper selection of foam material and the projection or leg stiffness must be selected. As discussed in the summary of the invention, and illustrated in FIGS. 10 and 11, such a unique interaction of elements, i.e., the low hardness foam and the insert members, results in a sole layer with greatly improved shock absorbing capability over current midsole structures.

Numerous characteristics and advantages of the invention have been set forth in the foregoing description, together with details of the structure and function of the invention, and the novel features hereof are pointed out in the appended claims. The disclosure, however, is illustrative only, and changes may be made in detail, especially in matters, shape, size and arrangement of parts, within the principle of the invention, to the full extend indicated by the broad general meaning of the terms in which the appended claims are expressed.

We claim:

1. A shock absorbing member for use in a sole of footwear comprising:

a plurality of elongate base elements interconnected to delineate the base perimeters of a plurality of interconnected open cells;

a plurality of elongate flexible legs extending from said base elements in a plurality of groups of elements converging toward one another to define a plurality of generally conical shaped projections; and a plurality of connecting elements, each connecting the convergent ends of said flexible legs of one of said conical shaped projections, whereby a load placed on said base elements or said connecting elements causes said flexible legs to resiliently flex to absorb said load.

2. A shock absorbing member in accordance with claim 1 wherein said base elements, connecting elements and legs are formed of a single integral piece of plastic material.

3. A shock absorbing member in accordance with claim 2 wherein said plastic material has a flex modulus of between approximately 2,000 PSI and 9,000 PSI.

4. A shock absorbing member in accordance with claim 2 wherein said legs have an average thickness within the range of 20 to 100 thousandths of an inch.

5. A shock absorbing material in accordance with claim 1 wherein said base elements are substantially linear and said cells are polygons.

6. A shock absorbing member in accordance with claim 5 wherein said flexible legs are substantially linear.

7. A shock absorbing member in accordance with claim 6 wherein each flexible leg has a break point along its length defining a location at which the flexible leg tends to flex.

8. A shock absorbing member in accordance with claim 5 wherein one of said flexible legs extends from each corner of said polygon cells.

9. A shock absorbing member in accordance with claim 1 wherein said base elements, said connecting elements and legs are encased in a resilient elastomeric foam having a density no higher than 0.4 and a hardness between approximately 20 and 50 durometer on the Asker C scale.

10. A shock absorbing member in accordance with claim 1 wherein said base elements, said connecting elements and said legs are encased in a low density, low hardness resilient elastomeric foam.

11. In an athletic shoe having an upper and a sole, the sole including a shock absorbing sole member comprising:

an insert member formed of resilient plastic material, said insert member including a plurality of transversely and longitudinally spaced discrete shock absorbing projections; and an elastomeric foam member encasing said insert member, said elastomeric foam material having a hardness of less than 70 durometer on the Asker C scale;

said shock absorbing projections comprising generally conical shaped projections defined by groups of converging elongate, spaced flexible legs extending between a base element and a plurality of discrete connecting elements whereby a conical side of a projection defined by one of the groups of flexible legs is primarily open space, and interior voids are defined within the legs of a projection and exterior voids are defined between the legs of adjacent projections with said foam material filling said interior and exterior voids.

12. A shock absorbing sole member in accordance with claim 11 wherein the hardness of said foam material is between approximately 20 and 50 durometer on the Asker C scale.

13. A shock absorbing sole member in accordance with claim 11 wherein said base elements are formed as elongate interconnected elements to which the divergent ends of said flexible legs are attached, said elongate interconnected elements defining a plurality of interconnected open cells.

14. A shock absorbing sole member in accordance with claim 13 wherein said foam material fills in the open space between said flexible legs, the open cells and the open space within and between said projections.

15. A shock absorbing sole member in accordance with claim 13 wherein said flexible legs have an average thickness between 20 and 100 thousandths of an inch.

16. A shock absorbing sole member in accordance with claim 15 wherein the average thickness of said flexible legs varies at various locations along the sole with the thickest legs located in the ball area and along the sides of the heel area, and the thinnest legs located in the toe area and the center of the heel area.

17. A shock absorbing sole member in accordance with claim 13 wherein the hardness of said foam material is between approximately 20 and 50 durometer on the Asker C scale.

18. A shock absorbing sole member in accordance with claim 13 wherein said elongate interconnected elements are substantially linear and said cells are polygons.

19. A shock absorbing sole member in accordance with claim 18 wherein said flexible legs have first ends connected to the corners of said polygons.

20. A shock absorbing sole member in accordance with claim 13 wherein two layers of said shock absorbing projections are located in the heel area with their respective connecting elements attached to one another.

21. A shock absorbing sole member in accordance with claim 11 wherein at least two layers of said shock absorbing projections are located in the heel area to form a portion of a heel lift.

22. In an athletic shoe having an upper and a sole, the sole including a shock absorbing sole member comprising first and second shock absorbing means for cooperatively working to absorb the force of foot strike, said first and second shock absorbing means having a predetermined thickness and being compressible to a percentage of said thickness during normal force loads generated during athletic activity, said first shock absorbing means supplying the primary resistance to compression during initial low level loads and the initial portion of the compression of said sole member and the combination of said first and second shock absorbing means supplying the primary resistance to compression during higher level loads and the final portion of the compression of said sole member, said first shock absorbing means including a plurality of transversely and longitudinally spaced shock absorbing projections, each shock absorbing projection including a plurality of flexible, convergent plastic legs, and said second shock absorbing means including a low hardness elastomeric foam surrounding said shock absorbing projections.

23. A shock absorbing sole member in accordance with claim 22 wherein each of said legs includes a deflection point at which flexing of said legs tends to occur.

24. A shock absorbing sole member in accordance with claim 22 wherein said legs have a flex modulus between 2,000 PSI and 9,000 PSI.

25. A shock absorbing sole member in accordance with claim 24 wherein said legs have an average thicknes between 0.020 of an inch and 0.100 of an inch.

26. A shock absorbing sole member in accordance with claim 25 wherein said elastomeric foam has a hardness of less than 70 durometer on the Asker C scale.

27. In an athletic shoe having an upper and a sole, the sole including a shock absorbing sole member comprising a plastic insert member including a plurality of collapsible projections and a low hardness elastomeric foam encasing said projections, said projections having an initial resistance to collapse and a buckling point at a predetermined force after which resistance to collapse decreases, said elastomeric foam having an initial resistance to compression less than said initial resistance to collapse of said projections, the resistance to compression of said elastomeric foam combining with the resistance to collapse of said projections after the buckle point is reached to prevent the bottoming out of said projections immediately after said buckling of said projections and to extend the shock absorbing capability of said sole member beyond the shock absorbing capability of said insert member and said elastomeric foam independent of one another.

28. A shock absorbing sole member in accordance with claim 27 wherein said projections include a plurality of flexible legs.

29. A shock absorbing sole member in accordance with claim 28 wherein said legs are arranged in a plurality of convergent groups defining a plurality of generally frusto-conical shaped projections.

30. A shock absorbing sole member in accordance with claim 28 wherein said legs have a break point at which said legs tend to collapse.

31. A shock absorbing sole member in accordance with claim 27 wherein said elastomeric foam has a hardness of less than approximately 70 durometer on the Asker C scale.

32. An athletic shoe in accordance with claim 31 wherein the hardness of said foam material is between approximately 20 and 50 durometer on the Asker C scale.

33. An athletic shoe comprising:

an upper;

a sole attached to said upper, said sole including an outer sole layer for contacting the ground and a shock absorbing midsole layer secured between said upper and said outer sole layer;

said shock absorbing midsole layer including an insert member formed of resilient plastic material and an elastomeric foam encasing said insert member, said elastomeric foam having a hardness less than 70 durometer on the Asker C scale, and said insert member including a plurality of transversely and longitudinally spaced discrete shock absorbing projections;

said shock absorbing projections comprising generally conical shaped projections defined by groups of converging, elongate, spaced flexible legs extending between a base element and a plurality of discrete connecting elements whereby a conical side of a projection defined by one of the groups of flexible legs is primarily open space, and interior voids are defined within the legs of a projection and exterior voids are defined between the legs of adjacent projections with said foam material filling said interior and exterior voids.

34. An athletic shoe in accordance with claim 33 wherein said base elements are formed as elongate interconnected elements to which the divergent ends of said flexible legs are attached, said elongate interconnected elements defining a plurality of interconnected open cells.

35. An athletic shoe in accordance with claim 34 wherein said foam material fills in the open space between said flexible legs, the open cells and the open space within and between said projections.

36. An athletic shoe in accordance with claim 34 wherein said flexible legs have an average thickness between 20 and 100 thousandths of an inch.

37. An athletic shoe in accordance with claim 36 wherein the average thickness of said flexible legs varies at various locations along the sole.

38. An athletic shoe in accordance with claim 34 wherein the hardness of said foam material is between approximately 20 and 50 durometer on the Asker C scale.

39. An athletic shoe in accordance with claim 34 wherein said elongate interconnected elements are substantially linear and said cells are polygons.

40. An athletic shoe in accordance with claim 39 wherein said flexible legs of said side element have first ends connected to the corners of said polygons.

41. An athletic shoe in accordance with claim 39 wherein at least two layers of said shock absorbing projections are located in a heel area to form a portion of a heel lift.

* * * * *

UNITED STATES PATENT AND TRADEMARK OFFICE

CERTIFICATE OF CORRECTION

PATENT NO. : 4,535,553

DATED : August 20, 1985

INVENTOR(S) : Thomas Derderian, Edward C. Frederick and Alexander L. Gross

It is certified that error appears in the above—identified patent and that said Letters Patent is hereby corrected as shown below:

Column 6, line 16, change "=" to --50—;

Claim 41, column 12, line 19, "39" should be changed to —33—; and line 21, "said" should be changed to —a—.

Signed and Sealed this

*Twenty-ninth* Day of *October 1985*

[SEAL]

*Attest:*

DONALD J. QUIGG

*Attesting Officer*

*Commissioner of Patents and Trademarks—Designate*